US005624532A

United States Patent [19]

Trokhan et al.

[11] Patent Number: 5,624,532

[45] Date of Patent: Apr. 29, 1997

[54] METHOD FOR ENHANCING THE BULK SOFTNESS OF TISSUE PAPER AND PRODUCT THEREFROM

[75] Inventors: Paul D. Trokhan, Hamilton; Dean V. Phan, West Chester, both of Ohio

[73] Assignee: The Procter & Gamble Company, Cincinnati, Ohio

[21] Appl. No.: 388,970

[22] Filed: Feb. 15, 1995

[51] Int. Cl.[6] ..... D21H 21/22

[52] U.S. Cl. ..... 162/111; 162/112; 162/113; 162/158; 162/164.1; 162/164.3; 162/164.6; 162/168.1; 162/168.2; 162/168.3; 162/175; 162/177; 162/184; 162/186

[58] Field of Search ..... 162/111, 112, 162/113, 158, 184, 186, 175, 164.3, 177, 168.1, 168.2, 168.3; 164/164.1, 164.6

[56] References Cited

U.S. PATENT DOCUMENTS

| | | | |
|---|---|---|---|
| 2,018,244 | 10/1935 | Alm | 162/112 |
| 3,301,746 | 1/1967 | Sanford et al. | 162/113 |
| 3,817,827 | 6/1974 | Benz | 162/113 |
| 3,974,025 | 8/1976 | Ayers | 162/113 |
| 3,994,771 | 11/1976 | Morgan , Jr. et al. | 162/113 |
| 4,158,594 | 6/1979 | Becker et al. | 162/112 |
| 4,191,609 | 3/1980 | Trokhan | 162/113 |
| 4,300,981 | 11/1981 | Carstens | 162/109 |
| 4,303,471 | 12/1981 | Laursen | 162/158 |
| 4,351,699 | 9/1982 | Osborn , III | 162/112 |
| 4,377,543 | 3/1983 | Strohbeen et al. | 264/120 |
| 4,425,186 | 1/1984 | May et al. | 162/158 |
| 4,432,833 | 2/1984 | Breese | 162/158 |
| 4,441,962 | 4/1984 | Osborn , III | 162/111 |
| 4,447,294 | 5/1984 | Osborn, III | 162/158 |
| 4,529,480 | 7/1985 | Trokhan | 162/109 |
| 4,637,859 | 1/1987 | Trokhan | 162/109 |
| 4,795,530 | 1/1989 | Soerens et al. | 162/111 |
| 4,853,086 | 8/1989 | Graef | 162/157.6 |
| 4,940,513 | 7/1990 | Spendel | 162/112 |
| 4,959,125 | 9/1990 | Spendel | 162/158 |
| 4,981,557 | 1/1991 | Bjorkquist | 162/168.2 |
| 5,066,414 | 11/1991 | Chang | 252/8.8 |
| 5,217,576 | 6/1993 | Phan | 162/158 |
| 5,223,096 | 6/1993 | Phan et al. | 162/158 |
| 5,240,562 | 8/1993 | Phan et al. | 162/158 |
| 5,262,007 | 11/1993 | Phan et al. | 162/158 |
| 5,264,082 | 11/1993 | Phan et al. | 162/158 |
| 5,279,767 | 1/1994 | Phan et al. | 252/357 |
| 5,385,643 | 1/1995 | Ampulski | 162/135 |
| 5,389,204 | 2/1995 | Ampulski | 162/135 |
| 5,405,501 | 4/1995 | Phan et al. | 162/127 |

FOREIGN PATENT DOCUMENTS

| | | |
|---|---|---|
| 4-100995 | 4/1992 | Japan . |

*Primary Examiner*—Peter Chin

*Attorney, Agent, or Firm*—Bart S. Hersko; E. Kelly Linman; Jacobus C. Rasser

[57] ABSTRACT

Tissue paper having an enhanced bulk softness through incorporation of an effective amount of a polyhydroxy compound is disclosed. Preferably, from about 0.1% to about 2.0% of the polyhydroxy compound, on a dry fiber weight basis. These nonionic compounds have high rates of retention when applied to wet tissue paper webs according to the process described herein. Tissue embodiments of the present invention may further comprise a quantity of strength additive, such as starch, to increase paper strength.

22 Claims, 4 Drawing Sheets

METHOD FOR ENHANCING THE BULK SOFTNESS OF TISSUE PAPER AND PRODUCT THEREFROM

FIELD OF THE INVENTION

This application relates to tissue papers, in particular pattern densified tissue papers, having an enhanced tactile sense of softness. This application particularly relates to tissue papers treated with water-soluble polyhydroxy compounds.

BACKGROUND OF THE INVENTION

Paper webs or sheets, sometimes called tissue or paper tissue webs or sheets, find extensive use in modern society. These include such staple items as paper towels, facial tissues and sanitary (or toilet) tissues. These paper products can have various desirable properties, including wet and dry tensile strength, absorbency for aqueous fluids (e.g., wettability), low lint properties, desirable bulk, and softness. The particular challenge in papermaking has been to appropriately balance these various properties to provide superior tissue paper.

Although somewhat desirable for towel products, softness is a particularly important property for facial and toilet tissues. Softness is the tactile sensation perceived by the consumer who holds a particular paper product, rubs it across the skin, and crumples it within the hand. Such tactile perceivable softness can be characterized by, but is not limited to, friction, flexibility, and smoothness, as well as subjective descriptors, such as a feeling like velvet, silk or flannel. This tactile sensation is a combination of several physical properties, including the flexibility or stiffness of the sheet of paper, the frictional properties of the web, as well as the texture of the surface of the paper.

Stiffness of paper is typically affected by efforts to increase the dry and/or wet tensile strength of the web. Increases in dry tensile strength can be achieved either by mechanical processes to insure adequate formation of hydrogen bonding between the hydroxyl groups of adjacent papermaking fibers, or by the inclusion of certain dry strength additives. Wet strength is typically enhanced by the inclusion of certain wet strength resins, that, being typically cationic, are easily deposited on and retained by the anionic carboxyl groups of the papermaking fibers. However, the use of both mechanical and chemical means to improve dry and wet tensile strength can also result in stiffer, harsher feeling, less soft tissue papers.

Certain chemical additives, commonly referred to as debonding agents, can be added to papermaking fibers to interfere with the natural fiber-to-fiber bonding that occurs during sheet formation and drying, and thus lead to softer papers. These debonding agents are typically cationic and have certain disadvantages associated with their use in softening tissue papers. Some low molecular weight cationic debonding agents can cause excessive irritation upon contact with human skin. Higher molecular weight cationic debonding agents can be more difficult to apply at low levels to tissue paper, and also tend to have undesirable hydrophobic effects on the tissue paper, e.g., result in decreased absorbency and particularly wettability. Since these cationic debonding agents operate by disrupting interfiber bonding, they can also decrease tensile strength to such an extent that resins, latex, or other dry strength additives can be required to provide acceptable levels of tensile strength. These dry strength additives not only increase the cost of the tissue paper but can also have other, deleterious effects on tissue softness. In addition, many cationic debonding agents are not biodegradable, and therefore can adversely impact on environmental quality.

Examples of cationic debonding agents include conventional quaternary ammonium compounds such as the well known dialkyl dimethyl ammonium salts (e.g. ditallow dimethyl ammonium chloride, ditallow dimethyl ammonium methyl sulfate, di(hydrogenated) tallow dimethyl ammonium chloride etc . . . ). However, as mentioned above, these cationic quaternary ammonium compounds soften the paper by interfering with the natural fiber-to-fiber bonding that occurs during sheet formation and drying. In addition to decreasing tensile strength, these quaternary ammonium compounds also tend to have undesirable hydrophobic effects on the tissue paper, e.g., resulting in decreased absorbency and wettability.

Mechanical pressing operations are typically applied to tissue paper webs to dewater them and/or increase their tensile strength. Mechanical pressing can occur over the entire area of the paper web, such as in the case of conventional felt-pressed paper. More preferably, dewatering is carried out in such a way that the paper is pattern densified. Pattern densified paper has certain densified areas of relatively high fiber density, as well as relatively low fiber density, high bulk areas. Such high bulk pattern densified papers are typically formed from a partially dried paper web that has densified areas imparted to it by a foraminous fabric having a patterned displacement of knuckles. See, for example, U.S. Pat. No. 3,301,746 (Sanford et al), issued Jan. 31, 1967; U.S. Pat. No. 3,994,771 (Morgan et al), issued Nov. 30, 1976; and U.S. Pat. No. 4,529,480 (Trokhan), issued Jul. 16, 1985.

Besides tensile strength and bulk, another advantage of such patterned densification processes is that ornamental patterns can be imprinted on the tissue paper. However, an inherent problem of patterned densification processes is that the fabric side of the tissue paper, i.e. the paper surface in contact with the foraminous fabric during papermaking, is sensed as rougher than the side not in contact with the fabric. This is due to the high bulk fields that form, in essence, protrusions outward from the surface of the paper. It is these protrusions that can impart a tactile sensation of roughness.

The softness of these compressed, and particularly patterned densified tissue papers, can be improved by treatment with various agents such as vegetable, animal or synthetic hydrocarbon oils, and especially polysiloxane materials typically referred to as silicone oils. See Column 1, lines 30–45 of U.S. Pat. No. 4,959,125 (Spendel), issued Sep. 25, 1990. These silicone oils impart a silky, soft feeling to the tissue paper. However, some silicone oils are hydrophobic and can adversely affect the surface wettability of the treated tissue paper, i.e. the treated tissue paper can float, thus causing disposal problems in sewer systems when flushed. Indeed, some silicone softened papers can require treatment with other surfactants to offset this reduction in wettability caused by the silicone. See U.S. Pat. No. 5,059,282 (Ampulski et al), issued Oct. 22, 1991.

Tissue paper has also been treated with softeners by "dry web" addition methods. One such method involves moving the dry paper across one face of a shaped block of wax-like softener that is then deposited on the paper surface by a rubbing action. See U.S. Pat. No. 3,305,392 (Britt), issued Feb. 21, 1967 (softeners include stearate soaps such as zinc stearate, stearic acid esters, stearyl alcohol, polyethylene glycols such as Carbowax, and polyethylene glycol esters of stearic and lauric acids). Another such method involves dipping the dry paper in a solution or emulsion containing the softening agent. See U.S. Pat. No. 3,296,065 (O'Brien et al), issued Jan. 3, 1967 (aliphatic esters of certain aliphatic or aromatic carboxylic acids as the softening agent). A potential problem of these prior "dry web" addition methods is that the softening agent can be applied less effectively, or in a manner that could potentially affect the absorbency of the tissue paper. Indeed, the '392 patent teaches as desirable modification with certain cationic materials to avoid the tendency of the softener to migrate. Application of softeners by either a rubbing action or by dipping the paper would also be difficult to adapt to commercial papermaking systems that run at high speeds. Furthermore, some of the softeners (e.g., the pyromellitate esters of the '065 patent), as well as some of the co-additives (e.g., dimethyl distearyl ammonium chloride of the '532 patent), taught to be useful in these prior "dry web" methods are not biodegradable.

Accordingly, it would be desirable to be able to soften tissue paper, in particular high bulk, pattern densified tissue papers, by a process that: (1) uses a "wet web" method for adding the softening agent; (2) can be carried out in a commercial papermaking system without significantly impacting on machine operability; (3) uses softeners that are nontoxic and biodegradable; and (4) can be carried out in a manner so as to maintain desirable tensile strength, absorbency and low lint properties of the tissue paper.

It is an object of this invention to provide soft, absorbent toilet tissue paper products.

It is an object of this invention to provide soft, absorbent facial tissue paper products.

It is an object of this invention to provide soft, absorbent paper towel products.

It is also a further object of this invention to provide a process for making soft, absorbent tissue (i.e., facial and/or toilet tissue) and paper towel products.

These and other objects are obtained using the present invention, as will become readily apparent from a reading of the following disclosure.

SUMMARY OF THE INVENTION

The present invention provides soft, absorbent tissue paper products. Briefly, the soft tissue paper products comprise:

a) wet-laid cellulosic fibers; and b) from about 0.01% to about 5% of a water soluble polyhydroxy compound, based on the dry fiber weight of said tissue paper;

wherein said tissue paper has a basis weight of from about 10 to about 65 g/m$^2$ and a density of less than about 0.60 g/cc and wherein said polyhydroxy compound having being applied to a least one surface of a wet tissue paper web.

The present invention further relates to a process for making these softened tissue papers. The process includes the steps:

a) wetlaying an aqueous slurry containing cellulosic fibers to form a web;

b) applying to said web at fiber consistency of from about 10% to about 80%, total web weight basis, a sufficient amount of a water soluble polyhydroxy compound to impart a bulk softness to said structure; and c) drying and creping said web.

Suprisingly, it has been found that these nonionic polyhydroxy compounds have high rates of retention even in the absence of cationic retention aids or debonding agents when applied to wet tissue paper webs in accordance with the process disclosed herein. This is especially unexpected because the polyhydroxy compounds are applied to the wet webs under conditions wherein they are not ionically substantive to the cellulose fibers. Importantly, the wet web process allows the polyhydroxy compounds to migrate to the interior of the paper web where they act to enhance the tissue paper absorbency and softness.

Surprisingly, it has been found that significantly improved tissue softening benefits can be achieved by much lower levels of these polyhydroxy compounds when applied to a wet web, as compared to a dry web (e.g., during the converting operation). In fact, an important feature of the process disclosed herein, is that the polyhydroxy compound level is low enough to be economical.

Tissue paper softened according to the present invention has good flexibility. It is especially useful in softening high bulk, pattern densified tissue papers, including tissue papers having patterned designs. Surprisingly, even when the softener is applied only to the smoother (i.e., wire) side of such pattern densified papers, the treated paper is still perceived as soft. The present invention can be carried out in a commercial papermaking system without significantly impacting on machine operability, including speed. The improved softness benefits of the present invention can also be achieved while maintaining the desirable tensile strength, absorbency (e.g., wettability), and low lint properties of the paper.

All percentages, ratios and proportions herein are by weight unless otherwise specified.

DETAILED DESCRIPTION OF THE INVENTION

Figure 1:
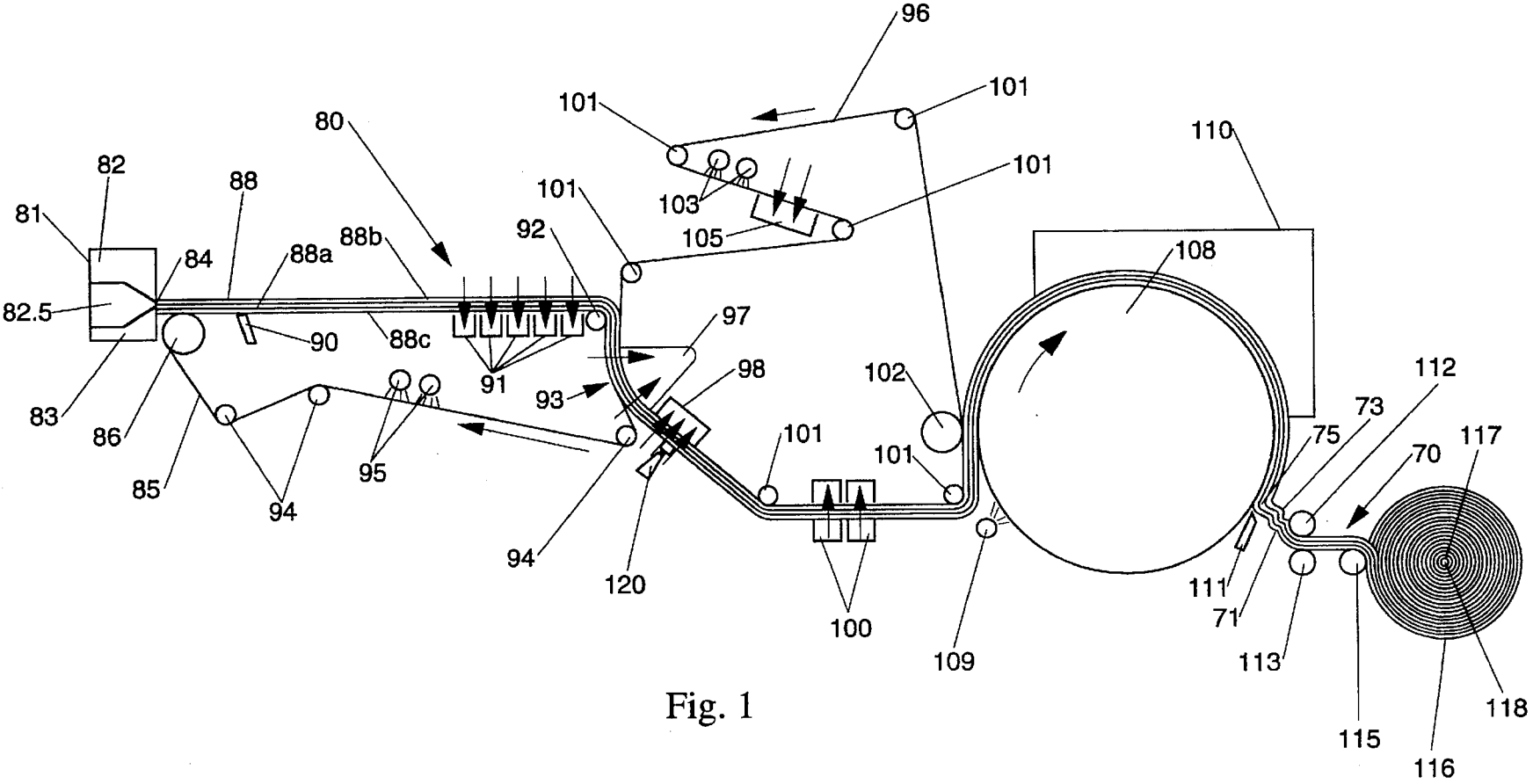
FIG. 1 is a schematic representation of a papermaking machine useful for making pattern densified tissue paper in accordance with the present invention.

While this specification concludes with claims particularly pointing out and distinctly claiming the subject matter regarded as the invention, it is believed that the invention can be better understood from a reading of the following detailed description and of the appended examples.

As used herein, the term "comprising" means that the various components, ingredients, or steps, can be conjointly employed in practicing the present invention. Accordingly, the term "comprising" encompasses the more restrictive terms "consisting essentially of" and "consisting of".

As used herein, the terms teissue paper web, paper web, web, paper sheet and paper product all refer to sheets of paper made by a process comprising the steps of forming an aqueous papermaking furnish, depositing this furnish on a foraminous surface, such as a Fourdrinier wire, and removing the water from the furnish as by gravity or vacuum-assisted drainage, with or without pressing, and by evaporation.

As used herein, an aqueous papermaking furnish is an aqueous slurry of papermaking fibers and the chemicals described hereinafter.

As used herein, the term "consistency" refers to the weight percentage of the cellulosic paper making fibers (i.e., pulp) in the wet tissue web. It is expressed as a weight percentage of this fibrous material, in the wet web, in terms of air dry fiber weight divided by the weight of the wet web.

The first step in the process of this invention is the forming of an aqueous papermaking furnish. The furnish comprises papermaking fibers (hereinafter sometimes referred to as wood pulp). It is anticipated that wood pulp in all its varieties will normally comprise the papermaking fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and chemically modified thermomechanical pulp (CTMP). Pulps derived from both deciduous and coniferous trees can be used. Also applicable to the present invention are fibers derived from recycled paper, which may contain any or all of the above categories as well as other non-fibrous materials such as fillers and adhesives used to facilitate the original papermaking. Preferably, the papermaking fibers used in this invention comprise Kraft pulp derived from northern softwoods and/or tropical hardwoods. The aqueous papermaking furnish is formed into a wet web on a foraminous forming carrier, such as a Fourdrinier wire, as will be discussed hereinafter.

(A) Polyhydroxy Compounds

The present invention contains as an essential component from about 0.01% to about 5.0%, preferably from 0.1% to about 2.0%, more preferably from about 0.1% to about 1.0%, of a water soluble polyhydroxy compound, based on the dry fiber weight of the tissue paper.

Examples of water soluble polyhydroxy compounds suitable for use in the present invention include glycerol, polyglycerols having a weight average molecular weight of from about 150 to about 800 and polyoxyethylene and polyoxypropylene having a weight-average molecular weight of from about 200 to about 4000, preferably from about 200 to about 1000, most preferably from about 200 to about 600. Polyoxyethylene having an weight average molecular weight of from about 200 to about 600 are especially preferred. Mixtures of the above-described polyhydroxy compounds may also be used. For example, mixtures of glycerol and polyglycerols, mixtures of glycerol and polyoxyethylenes, mixtures of polyglycerols and polyoxyethylenes, etc. are useful in the present invention. A particularly preferred polyhydroxy compound is polyoxyethylene having an weight average molecular weight of about 400. This material is available commercially from the Union Carbide Company of Danbury, Conn. under the trade name "PEG-400".

(B) Tissue Papers

The present invention is applicable to tissue paper in general, including but not limited to conventionally felt-pressed tissue paper; pattern densified tissue paper such as exemplified in the aforementioned U.S. Patent by Sanford-Sisson and its progeny; and high bulk, uncompacted tissue paper such as exemplified by U.S. Pat. No. 3,812,000, Salvucci, Jr., issued May 21, 1974. The tissue paper may be of a homogenous or multi-layered construction; and tissue paper products made therefrom may be of a single-ply or multi-ply construction. Tissue structures formed from layered paper webs are described in U.S. Pat. No. 3,994,771, Morgan, Jr. et al. issued Nov. 30, 1976, U.S. Pat. No. 4,300,981, Carstens, issued Nov. 17, 1981, U.S. Pat. No. 4,166,001, Dunning et al., issued Aug. 28, 1979, and European Patent Publication No. 0 613 979 A1, Edwards et al., published Sep. 7, 1994, all of which are incorporated herein by reference. In general, a wet-laid composite, soft, bulky and absorbent paper structure is prepared from two or more layers of furnish which are preferably comprised of different fiber types. The layers are preferably formed from the deposition of separate streams of dilute fiber slurries, the fibers typically being relatively long softwood and relatively short hardwood fibers as used in tissue papermaking, upon one or more endless foraminous screens. The layers are subsequently combined to form a layered composite web. The layered web is subsequently caused to conform to the surface of an open mesh drying/imprinting fabric by the application of a fluid force to the web and thereafter thermally predried on said fabric as part of a low density papermaking process. The layered web may be stratified with respect to fiber type or the fiber content of the respective layers may be essentially the same. The tissue paper preferably has a basis weight of between 10 g/m$^2$ and about 65 g/m$^2$, and density of about 0.60 g/cc or less. Preferably, basis weight will be below about 35 g/m$^2$ or less; and density will be about 0.30 g/cc or less. Most preferably, density will be between 0.04 g/cc and about 0.20 g/cc.

Conventionally pressed tissue paper and methods for making such paper are known in the art. Such paper is typically made by depositing papermaking furnish on a foraminous forming wire. This forming wire is often referred to in the art as a Fourdrinier wire. Once the furnish is deposited on the forming wire, it is referred to as a web. The web is dewatered by pressing the web and drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dried by pressing operations wherein the web is subjected to pressure developed by opposing mechanical members, for example, cylindrical rolls.

The dewatered web is then further pressed and dried by a steam heated drum apparatus known in the art as a Yankee dryer. Pressure can be developed at the Yankee dryer by mechanical means such as an opposing cylindrical drum pressing against the web. Vacuum may also be applied to the web as it is pressed against the Yankee surface. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted since the web is subjected to substantial overall mechanical compressional forces while the fibers are moist and are then dried (and optionally creped) while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987, U.S. Pat. No. 4,942,077 issued to Wendt et al. on Jul. 17, 1990, European Patent Publication No. 0 617 164 A1, Hyland et al., published Sep. 28, 1994, European Patent Publication No. 0 616 074 A1, Hermans et al., published Sep. 21, 1994; all of which are incorporated herein by reference.

In general, pattern densified webs are preferably prepared by depositing a papermaking furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering can be performed with suction boxes or other vacuum devices or with blow-through dryers. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, non pattern densified tissue paper structures are prepared by depositing a papermaking furnish containing a debonding agent on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

Compacted non-pattern-densified tissue structures are commonly known in the art as conventional tissue structures. In general, compacted, non-patterndensified tissue paper structures are prepared by depositing a papermaking furnish on a foraminous wire such as a Fourdrinier wire to form a wet web, draining the web and removing additional water with the aid of a uniform mechanical compaction (pressing) until the web has a consistency of 25–50%, transferring the web to a thermal dryer such as a Yankee and creping the web. Overall, water is removed from the web by vacuum, mechanical pressing and thermal means. The resulting structure is strong and generally of singular density, but very low in bulk, absorbency and in softness.

The tissue paper web of this invention can be used in any application where soft, absorbent tissue paper webs are required. Particularly advantageous uses of the tissue paper web of this invention are in paper towel, toilet tissue and facial tissue products. For example, two tissue paper webs of this invention can be embossed and adhesively secured together in face to face relation as taught by U.S. Pat. No. 3,414,459, which issued to Wells on Dec. 3, 1968 and which is incorporated herein by reference, to form 2-ply paper towels.

In the following discussion, wherein reference is made to the several figures, certain preferred embodiments of processes for making the tissue sheet structures of the present invention are described.

FIG. 1 is side elevational view of a preferred papermaking machine 80 for manufacturing paper according to the present invention. Referring to FIG. 1, papermaking machine 80 comprises a layered headbox 81 having a top chamber 82 a center chamber 82.5, and a bottom chamber 83, a slice roof 84, and a Fourdrinier wire 85 which is looped over and about breast roll 86, deflector 90, vacuum suction boxes 91, couch roll 92, and a plurality of turning rolls 94. In operation, one papermaking furnish is pumped through top chamber 82 a second papermaking furnish is pumped through center chamber 82.5, while a third furnish is pumped through bottom chamber 83 and thence out of the slice roof 84 in over and under relation onto Fourdrinier wire 85 to form thereon an embryonic web 88 comprising layers 88*a*, and 88*b*, and 88*c*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101 after which the web is transferred to a Yankee dryer 108 by the action of pressure roll 102. The carrier fabric 96 is then cleaned and dewatered as it completes its loop by passing over and around additional turning rolls 101, showers 103, and vacuum dewatering box 105. The predried paper web is adhesively secured to the cylindrical surface of Yankee dryer 108 by adhesive applied by spray applicator 109. Drying is completed on the steam heated Yankee dryer 108 and by hot air which is heated and circulated through drying hood 110 by means not shown. The web is then dry creped from the Yankee dryer 108 by doctor blade 111 after which it is designated paper sheet 70 comprising a Yankee-side layer 71 a center layer 73, and an off-Yankee-side layer 75. Paper sheet 70 then passes between calendar rolls 112 and 113, about a circumferential portion of reel 115, and thence is wound into a roll 116 on a core 117 disposed on shaft 118.

Still referring to FIG. 1, the genesis of Yankee-side layer 71 of paper sheet 70 is the furnish pumped through bottom chamber 83 of headbox 81, and which furnish is applied directly to the Fourdrinier wire 85 whereupon it becomes layer 88*c* of embryonic web 88. The genesis of the center layer 73 of paper sheet 70 is the furnish delivered through under chamber 82.5 of headbox 81, and which furnish forms layer 88*b* on top of layer 88*c*. The genesis of the off-Yankee-side layer 75 of paper sheet 70 is the furnish delivered through top chamber 82 of headbox 81, and which furnish forms layer 88*a* on top of layer 88*b* of embryonic web 88. Although FIG. 1 shows papermachine 80 having headbox 81 adapted to make a three-layer web, headbox 81 may alternatively be adapted to make unlayered, two layer or other multi-layer webs. Furthermore the forming section and headbox can be any system suitable for making tissue such as a twin wire former.

Further, with respect to making paper sheet 70 embodying the present invention on papermaking machine 80, FIG. 1, the Fourdrinier wire 85 must be of a fine mesh having relatively small spans with respect to the average lengths of the fibers constituting the short fiber furnish so that good formation will occur; and the foraminous carrier fabric 96 should have a fine mesh having relatively small opening spans with respect to the average lengths of the fibers constituting the long fiber furnish to substantially obviate bulking the fabric side of the embryonic web into the inter-filamentary spaces of the fabric 96. Also, with respect to the process conditions for making exemplary paper sheet 70, the paper web is preferably dried to about 80% fiber consistency, and more preferably to about 95% fiber consistency prior to creping.

Specifically relating to FIG. 1, spray nozzle 120 is provided opposite vacuum dewatering box 98 for application of polyhydroxy compound.

Figure 2:
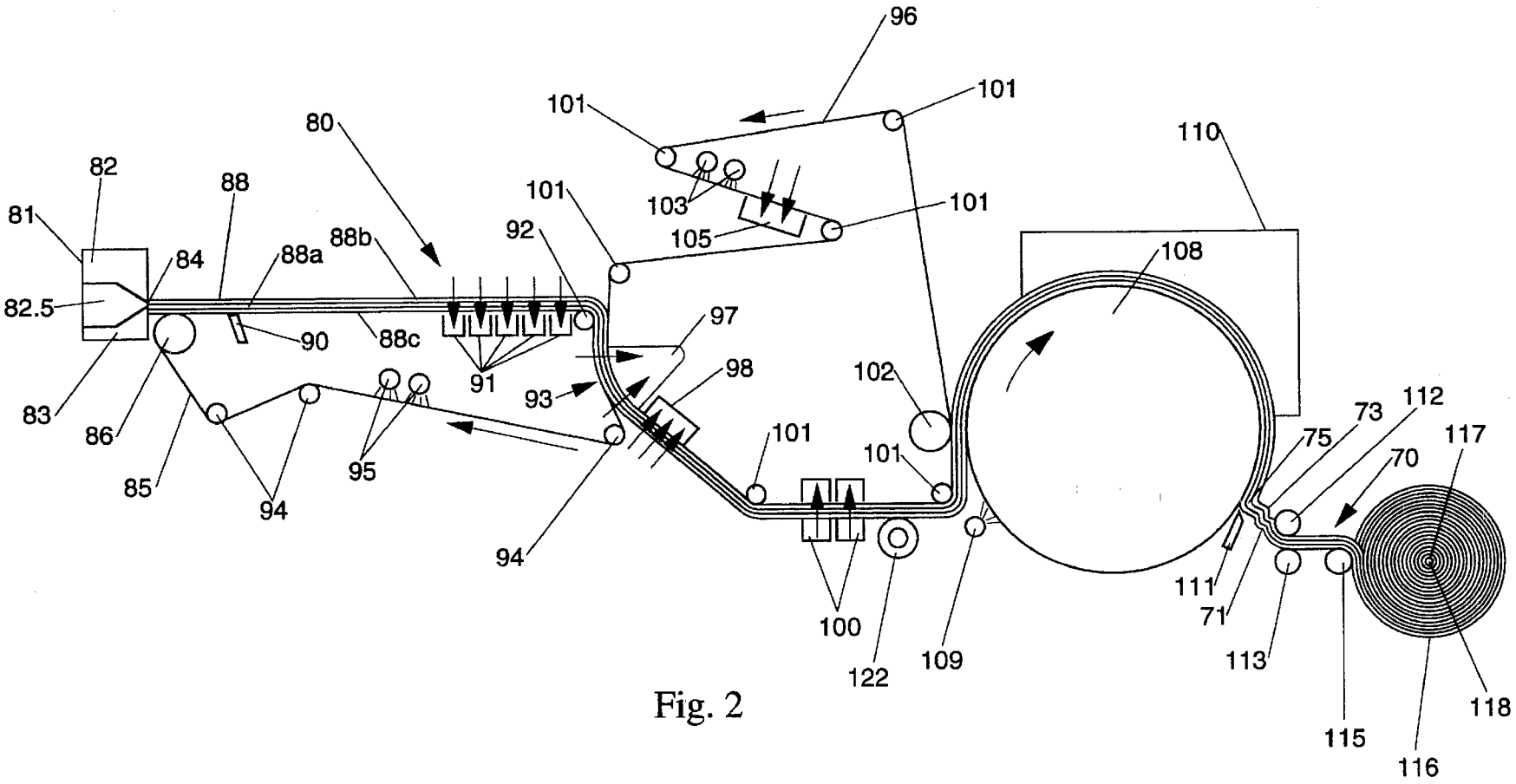
FIG. 2 is a schematic representation of a papermaking machine useful for making pattern densified tissue paper in accordance with the present invention, wherein the treatment chemicals contemplated for use herein are applied by an alternate method to that shown in FIG. 1.

FIG. 2 shows an alternate papermaking machine which is substantially the same as that shown in FIG. 1, except that the rotogravure printer 122 is provided between the predryers 100 and the Yankee dryer 108 in place of spray nozzle 120.

Figure 3:
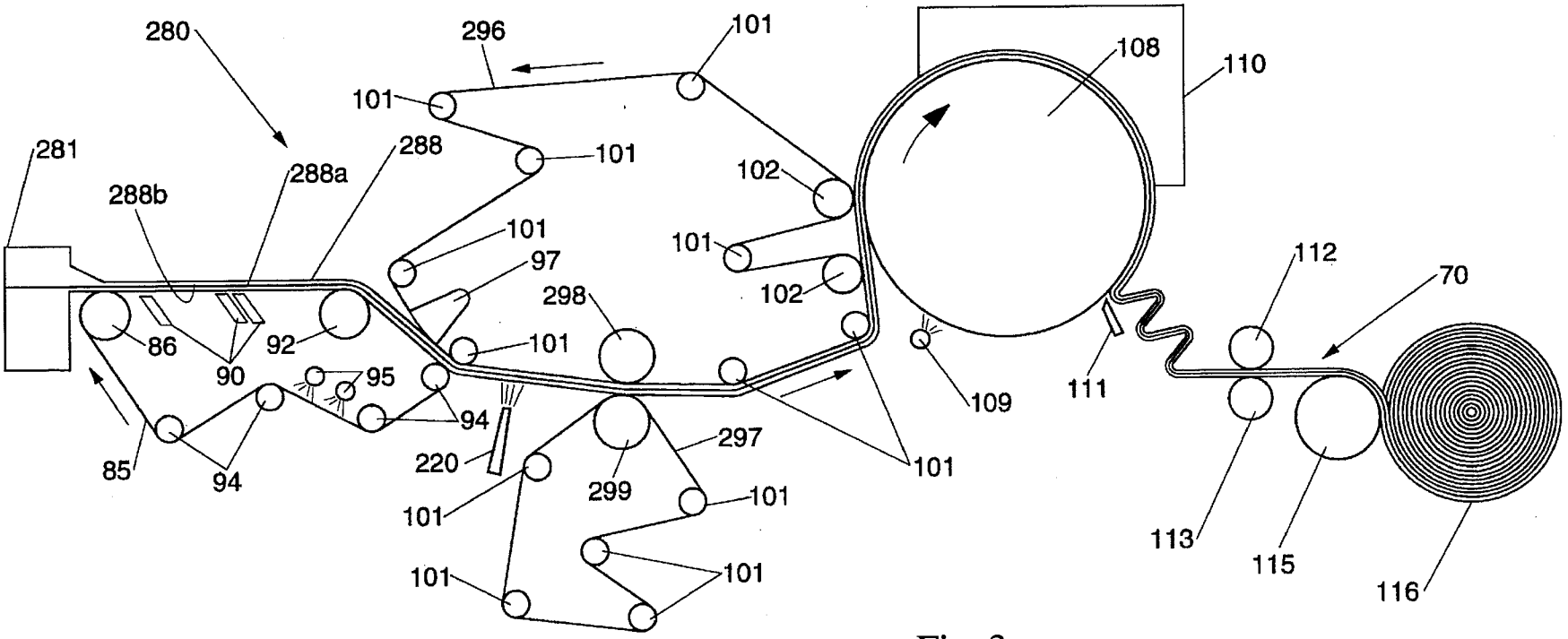
FIG. 3 is a schematic representation of a papermaking machine useful for making conventionally pressed tissue paper in accordance with the present invention.

FIG. 3 is a side elevational view of an alternate preferred papermaking machine for making tissue sheets by conventional papermaking techniques which were predominate prior to the invention of processes such as those shown in FIGS. 1–2 and described in U.S. Pat. No. 3,301,746, each of which utilizes blow through drying and minimizes compression of the tissue sheet. To simplify description of the alternate preferred papermaking machine of FIG. 3, the components which have counterparts in papermaking machine 80, FIG. 1, are identically designated; and the alternate papermaking machine 280 of FIG. 3 is described with respect to differences therebetween.

Papermaking machine 280 of FIG. 3 is essentially different from papermaking machine 80 of FIG. 1, by virtue of having a duplex headbox 281 comprising a top chamber 282 and a bottom chamber 283 in place of a triple headbox 81; by having a felt loop 296 in place of foraminous carrier fabric 96; by having two pressure rolls 102 rather than one; and by not having blow through dryers 100. Papermaking machine 280, FIG. 3, further comprises a lower felt loop 297 and wet pressing rolls 298 and 299 and means not shown for controllably biasing rolls 298 and 299 together. The lower felt loop 297 is looped about additional turning rolls 101 as illustrated. Papermaking machine 280 is considered a dual felt machine by virtue of having felt loops 296 and 297. Felt loop 297 can be eliminated, in which case papermachine 280 would be considered a single felt machine (not shown). Typically if run as a single felt machine at least one of the pressure roll (102) applies a vacuum to the wet web at the point of transfer to the Yankee dryer (108).

FIG. 3 further shows a two layered embryonic web 288 having layers 288*a* and 288*b* which becomes paper sheet 270 subsequent to drying at the Yankee dryer 108. Paper sheet 270 comprises Yankee side layer 271 and off-Yankee side layer 275.

Still referring to FIG. 3, a preferred embodiment is shown wherein spray nozzle 220 for application of the polyhydroxy compound located as shown between turning roll 101 and wet pressing roller 298 and 299, i.e . . . after embryonic web 88 has been transferred from Fourdrinier were 85 to felt loop 296. Though not shown, spray nozzle 220 can be alternately located after felt loop 297 and before Yankee dryer 108. Optionally nozzle 220 can spray into a vacuum box 106 located on the opposite side of felt 296.

Figure 4:
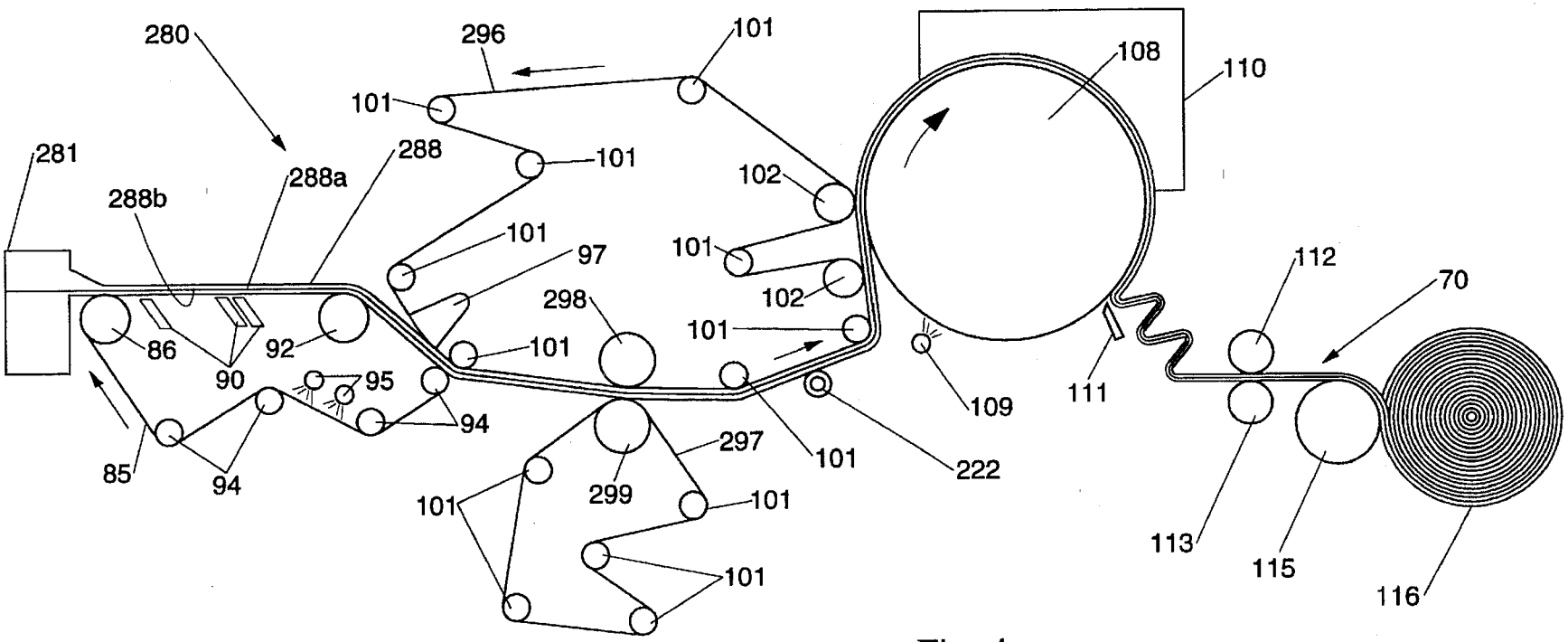
FIG. 4 is a schematic representation of a papermaking machine useful for making conventionally pressed tissue paper in accordance with the present invention, wherein the treatment chemicals contemplated for use herein are applied by an alternate method to that shown in FIG. 3.

FIG. 4 is substantially the same a FIG. 3, except that spray nozzle 220 is replaced by rotogravure printer 222.

The level of polyhydroxy compound to be retained by the tissue paper, as a minimum, is at least an effective level for imparting a bulk softness to the paper. The minimum effective level may vary depending upon the particular type of sheet, the method of application, the particular type of polyhydroxy compound, surfactant, or other additives or treatments. Without limiting the range of applicable polyhydroxy retention by the tissue paper, preferably at least about 0.05% of the polyhydroxy compound is retained by the tissue paper. More preferably, from about 0.1% to about 2.0% of the polyhydroxy compound is retained by the tissue paper.

Analytical and Testing Procedures

Analysis of the amounts of treatment chemicals herein retained on tissue paper webs can be performed by any method accepted in the applicable art. For example, the level of the polyhydroxy compound retained by the tissue paper can be determined by solvent extraction of the polyhydroxy compound with a solvent. In some cases, additional procedures may be necessary to remove interfering compounds from the polyhydroxy species of interest. For instance, the Weibull solvent extraction method employs a brine solution to isolate polyethylene glycols from nonionic surfactants (Longman, G. F., *The Analysis of Detergents and Detergent Products* Wiley Interscience, New York, 1975, p. 312). The polyhydroxy species could then be analyzed by spectroscopic or chromatographic techniques. For example, compounds with at least six ethylene oxide units can typically be analyzed spectroscopically by the Ammonium cobaltothiocyanate method (Longman, G. F., *The Analysis of Detergents and Detergent Products*, Wiley Interscience, New York, 1975, p. 346). Gas chromatography techniques can also be used to separate and analyze polyhydroxy type compounds. Graphitized poly(2,6-diphenyl-p-phenylene oxide) gas chromatography columns have been used to separate polyethylene glycols with the number of ethylene oxide units ranging from 3 to 9 (Alltech chromatography catalog, number 300, p. 158).

The level of nonionic surfactants, such as alkyl glycosides, can be determined by chromatographic techniques. Bruns reported a High Performance Liquid chromatography method with light scattering detection for the analysis of alkyl glycosides (Bruns, A., Waldhoff, H., Winkle, W., *Chromatographia*, vol. 27, 1989, p. 340). A Supercritical Fluid Chromatography (SFC) technique was also described in the analysis of alkyl glycosides and related species (Lafosse, M., Rollin, P., Elfakir, c., Morin-AIIory, L., Martens, M., Dreux, M., Journal of chromatography, vol. 505, 1990, p. 191). The level of anionic surfactants, such as linear alkyl sulfonates, can be determined by water extraction followed by titration of the anionic surfactant in the extract. In some cases, isolation of the linear alkyl sulfonate from interferences may be necessary before the two phase titration analysis (Cross, J., *Anionic Surfactants—Chemical Analysis*, Dekker, New York, 1977, p. 18, p. 222). The level of starch can be determined by amylase digestion of the starch to glucose followed by colorimetry analysis to determine glucose level. For this starch analysis, background analyses of the paper not containing the starch must be run to subtract out possible contributions made by interfering background species. These methods are exemplary, and are not meant to exclude other methods which may be useful for determining levels of particular components retained by the tissue paper.

A. Panel Softness

Ideally, prior to softness testing, the paper samples to be tested should be conditioned according to Tappi Method #T402OM-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

B. Hydrophilicity (Absorbency)

Hydrophilicity of tissue paper refers, in general, to the propensity of the tissue paper to be wetted with water. Hydrophilicity of tissue paper may be somewhat quantified by determining the period of time required for dry tissue paper to become completely wetted with water. This period of time is referred to as "wetting time". In order to provide a consistent and repeatable test for wetting time, the following procedure may be used for wetting time determinations: first, a conditioned sample unit sheet (the environmental conditions for testing of paper samples are 22° to 24° C. and 48 to 52% R.H. as specified in Tappi Method #T 402), approximately 4⅜ inch×4¾ inch (about 11.1 cm×12 cm) of tissue paper structure is provided; second, the sheet is folded into four (4) juxtaposed quarters, and then crumpled by hand (either covered with clean plastic gloves or copiously washed with a grease removing detergent such as Dawn®) into a ball approximately 0.75 inch (about 1.9 cm) to about 1 inch (about 2.5 cm) in diameter; third, the balled sheet is placed on the surface of a body of about 3 liters of distilled water at 22° to 24° C. contained in a 3 liter pyrex glass beaker. It should also be noted all testing of the paper through this technique should take place within the confines of the controlled temperature and humidity room at 22° to 24° C. and 48 to 52% relative humidity. The sample ball is then carefully placed on the surface of the water from a distance no greater than 1 cm above the water surface. At the exact moment the ball touches the water surface, a timer is simultaneously started; fourth, the second ball is placed in the water after the first ball is completely wetted out. This is easily noted by the paper color transitioning from its dry white color to a darker grayish coloration upon complete wetting. The timer is stopped and the time recorded after the fifth ball has completely wet out.

At least 5 sets of 5 balls (for a total of 25 balls) should be run for each sample. The final reported result should be the calculated average and standard deviation taken for the 5 sets of data. The units of the measurement are seconds. The water must be changed after the 5 sets of 5 balls (total=25 balls) have been tested. copious cleaning of the beaker may be necessary if a film or residue is noted on the inside wall of the beaker.

Another technique to measure the water absorption rate is through pad sink measurements. After conditioning the tissue paper of interest and all controls for a minimum of 24 hours at 22° to 24° C. and 48 to 52% relative humidity (Tappi method #T402OM-88), a stack of 5 to 20 sheets of tissue paper is cut to dimensions of 2.5" to 3.0". The cutting can take place through the use of dye cutting presses, a conventional paper cutter, or laser cutting techniques. Manual scissors cutting is not preferred due to both the irreproducibility in handling of the samples, and the potential for paper contamination.

After the paper sample stack has been cut, it is carefully placed on a wire mesh sample holder. The function of this holder is to position the sample on the surface of the water with minimal disruption. This holder is circular in shape and has a diameter of approximately 4.2". It has five straight and evenly spaced metal wires running parallel to one another and across to spot welded points on the wire's circumference. The spacing between the wires is approximately 0.7". This wire mesh screen should be clean and dry prior to placing the paper on its surface. A 3 liter beaker is filled with about 3 liters of distilled water stabilized at a temperature of 22° to 24° C. After insuring oneself that the water surface is free of any waves or surface motion, the screen containing the paper is carefully placed on top of the water surface. The screen sample holder is allowed to continue downward after the sample floats on the surface so the sample holder screen handle catches on the side of the beaker. In this way, the screen does not interfere with the water absorption of the paper sample. At the exact moment the paper sample touches the surface of the water, a timer is started. The timer is stopped after the paper stack is completely wetted out. This is easily visually observed by noting a transition in the paper color from its dry white color to a darker grayish coloration upon complete wetting. At the instant of complete wetting, the timer is stopped and the total time recorded. This total time is the time required for the paper pad to completely wet out.

This procedure is repeated for at least 2 additional tissue paper pads. No more than 5 pads of paper should be run without disposing of the water and post cleaning and refilling of the beaker with fresh water at a temperature of 22° to 24° C. Also, if new and unique sample is to be run, the water should always be changed to the fresh starting state. The final reported time value for a given sample should be the average and standard deviations for the 3 to 5 stacks measured. The units of the measurement are seconds.

Hydrophilicity characteristics of tissue paper embodiments of the present invention may, of course, be determined immediately after manufacture. However, substantial increases in hydrophobicity may occur during the first two weeks after the tissue paper is made: i.e., after the paper has aged two (2) weeks following its manufacture. Thus, the wetting times are preferably measured at the end of such two week period. Accordingly, wetting times measured at the end of a two week aging period at room temperature are referred to as "two week wetting times." Also, optional aging conditions of the paper samples may be required to try and mimic both long term storage conditions and/or possible severe temperature and humidity exposures of the paper products of interest. For instance, exposure of the paper sample of interest to temperatures in the range of 49° to 82° C. for 1 hour to 1 year can mimic some of potentially severe exposures conditions a paper sample may experience in the trade. Also, autoclaving of the paper samples can mimic severe aging conditions the paper may experience in the trade. It must be reiterated that after any severe temperature testing, the samples must be re-conditioned at a temperature of 22° to 24° C. and a relative humidity of 48 to 52%. All testing should also be done within the confines of the controlled temperature and humidity room.

C. Density

The density of tissue paper, as that term is used herein, is the average density calculated as the basis weight of that paper divided by the caliper, with the appropriate unit conversions incorporated therein to convert to g/cc. Caliper of the tissue paper, as used herein, is the thickness of the paper when subjected to a compressive load of 95 g/in$^2$ (15.5 g/cm$^2$). The caliper is measured with a Thwing-Albert model 89-II thickness tester (Thwing-Albert Co. of Philadelphia, Pa.). The basis weight of the paper is typically determined on a 4"×4" pad which is 8 plies thick. This pad is preconditioned according to Tappi Method #T402OM-88 and then the weight is measured in units of grams to the nearest ten-thousandths of a gram. Appropriate conversions are made to report the basis weight in units of pounds per 3000 square feet.

Optional Ingredients

Other chemicals commonly used in papermaking can be added to the chemical softening composition described herein, or to the papermaking furnish so long as they do not significantly and adversely affect the softening, absorbency of the fibrous material, and softness enhancing actions of the quaternary ammonium softening compounds of the present invention.

A. Wetting Agents

The present invention may contain as an optional ingredient from about 0.005% to about 3.0%, more preferably from about 0.03% to 1.0% by weight, on a dry fiber basis of a wetting agent.

Nonionic Surfactant (Alkoxylated Materials)

Suitable nonionic surfactants can be used as wetting agents in the present invention include addition products of ethylene oxide and, optionally, propylene oxide, with fatty alcohols, fatty acids, fatty amines, etc.

Any of the alkoxylated materials of the particular type described hereinafter can be used as the nonionic surfactant. Suitable compounds are substantially water-soluble surfactants of the general formula:

$$R_2—Y—(C_2H_4O)_z—C_2H_4OH$$

wherein $R_2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, in which $R_2$, and R, when present, have the meanings given herein before, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R_2$ and the number of ethoxylate groups, the HLB of the surfactant is, in general, determined. However, it is to be noted that the nonionic ethoxylated surfactants useful herein, for concentrated liquid compositions, contain relatively long chain $R_2$ groups and are relatively highly ethoxylated. While shorter alkyl chain surfactants having short ethoxylated groups may possess the requisite HLB, they are not as effective herein.

Examples of nonionic surfactants follow. The nonionic surfactants of this invention are not limited to these examples. In the examples, the integer defines the number of ethoxyl (EO) groups in the molecule.

Linear Alkoxylated Alcohols a. Linear, Primary Alcohol Alkoxylates

The deca-, undeca-, dodeca-, tetradeca-, and pentadeca-ethoxylates of n-hexadecanol, and n-octadecanol having an HLB within the range recited herein are useful wetting agents in the context of this invention. Exemplary ethoxylated primary alcohols useful herein as the viscosity/dispersibility modifiers of the compositions are n-$C_{18}$EO(10); and n-$C_{10}$EO(11). The ethoxylates of mixed natural or synthetic alcohols in the "oleyl" chain length range are also useful herein. Specific examples of such materials include oleylalcohol-EO(11), oleylalcohol-EO(18), and oleylalcohol-EO(25).

b. Linear, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range; recited herein can be used as wetting agents in the present invention. Exemplary ethoxylated secondary alcohols can be used as wetting agents in the present invention are: 2-$C_{16}$EO(11); 2-$C_{20}$EO(11); and 2-$C_{16}$EO(14).

Linear Alkyl Phenoxylated Alcohols

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the wetting agents of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

Olefinic Alkoxylates

The alkenyl alcohols, both primary and secondary, and alkenyl phenols corresponding to those disclosed immediately herein above can be ethoxylated to an HLB within the range recited herein can be used as wetting agents in the present invention Branched Chain Alkoxylates Branched chain primary and secondary alcohols which are available from the well-known "OXO" process can be ethoxylated and can be used as wetting agents in the present invention.

The above ethoxylated nonionic surfactants are useful in the present compositions alone or in combination, and the term "nonionic surfactant" encompasses mixed nonionic surface active agents.

The level of surfactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40 which is available from Croda, Inc. (New York, N.Y.); alkylglycoside ethers as described in U.S. Pat. No. 4,011,389, issued to W. K. Langdon, et al. on Mar. 8, 1977; and alkylpolyethoxylated esters such as Pegosperse 200 ML available from Glyco Chemicals, Inc. (Greenwich, Conn.) and IGEPAL RC-520 available from Rhone Poulenc Corporation (Cranbury, N.J.).

B. Strength additives

Other types of chemicals which may be added, include the strength additives to increase the dry tensile strength and the wet burst of the tissue webs. The present invention may contain as an optional component an effective amount, preferably from about 0.01% to about 3.0%, more preferably from about 0.2% to about 2.0% by weight, on a dry fiber weight basis, of a water-soluble strength additive resin. These strength additive resins are preferably selected from the group consisting of dry strength resins, permanent wet strength resins, temporary wet strength resins, and mixtures thereof.

(a) Dry Strength Additives

The dry strength additives are preferably selected from the group consisting of carboxymethyl cellulose resins, starch based resins and mixtures thereof. Examples of preferred dry strength additives include carboxymethyl cellulose, and cationic polymers from the ACCO chemical family such as ACCO 711 and ACCO 514, with ACCO chemical family being most preferred. These materials are available commercially from the American Cyanamid Company of Wayne, N.J.

(b) Permanent Wet Strength Additives

Permanent wet strength resins useful herein can be of several types. Generally, those resins which have previously found and which will hereafter find utility in the papermaking art are useful herein. Numerous examples are shown in the aforementioned paper by Westfelt, incorporated herein by reference.

In the usual case, the wet strength resins are water-soluble, cationic materials. That is to say, the resins are water-soluble at the time they are added to the papermaking furnish. It is quite possible, and even to be expected, that subsequent events such as cross-linking will render the resins insoluble in water. Further, some resins are soluble only under specific conditions, such as over a limited pH range.

Wet strength resins are generally believed to undergo a cross-linking or other curing reactions after they have been deposited on, within, or among the papermaking fibers. Cross-linking or curing does not normally occur so long as substantial amounts of water are present.

Preferably the permanent wet strength resin binder materials are selected from the group consisting of polyamide-epichlorohydrin resins, polyacrylamide resins, and mixtures thereof.

Of particular utility are the various polyamide-epichlorohydrin resins. These materials are low molecular weight polymers provided with reactive functional groups such as amino, epoxy, and azetidinium groups. The patent literature is replete with descriptions of processes for making such materials. U.S. Pat. No. 3,700,623, issued to Keim on Oct. 24, 1972 and U.S. Pat. No. 3,772,076, issued to Keim on Nov. 13, 1973 are examples of such patents and both are incorporated herein by reference.

Polyamide-epichlorohydrin resins sold under the trademarks Kymene 557H and Kymene 2064 by Hercules Incorporated of Wilmington, Del., are particularly useful in this invention. These resins are generally described in the aforementioned patents to Keim.

Base-activated polyamide-epichlorohydrin resins useful in the present invention are sold under the Santo Res trademark, such as Santo Res 31, by Monsanto Company of St. Louis, Mo. These types of materials are generally described in U.S. Pat. No. 3,855,158 issued to Petrovich on Dec. 17, 1974; U.S. Pat. No. 3,899,388 issued to Petrovich on Aug. 12, 1975; U.S. Pat. No. 4,129,528 issued to Petrovich on Dec. 12, 1978; U.S. Pat. No. 4,147,586 issued to Petrovich on Apr. 3, 1979; and U.S. Pat. No. 4,222,921 issued to Van Eenam on Sep. 16, 1980, all incorporated herein by reference.

Other water-soluble cationic resins useful herein are the polyacrylamide resins such as those sold under the Parez trademark, such as Parez 631NC, by American Cyanamid Company of Stanford, Conn. These materials are generally described in U.S. Pat. No. 3,556,932 issued to Coscia et al. on Jan. 19, 1971; and U.S. Pat. No. 3,556,933 issued to Williams et al. on Jan. 19, 1971, all incorporated herein by reference.

Other types of water-soluble resins useful in the present invention include acrylic emulsions and anionic styrene-butadiene latexes. Numerous examples of these types of resins are provided in U.S. Pat. No. 3,844,880, Meisel, Jr. et al., issued Oct. 29, 1974, incorporated herein by reference.

Still other water-soluble cationic resins finding utility in this invention are the urea formaldehyde and melamine formaldehyde resins. These polyfunctional, reactive polymers have molecular weights on the order of a few thousand. The more common functional groups include nitrogen containing groups such as amino groups and methylol groups attached to nitrogen.

Although less preferred, polyethylenimine type resins find utility in the present invention.

More complete descriptions of the aforementioned water-soluble resins, including their manufacture, can be found in TAPPI Monograph Series No. 29, *Wet Strength In Paper and Paperboard*, Technical Association of the Pulp and Paper Industry (New York; 1965), incorporated herein by reference. As used herein, the term "permanent wet strength resin" refers to a resin which allows the paper sheet, when placed in an aqueous medium, to keep a majority of its initial wet strength for a period of time greater than at least two minutes.

(c) Temporary Wet Strength Additives

The above-mentioned wet strength additives typically result in paper products with permanent wet strength, i.e., paper which when placed in an aqueous medium retains a substantial portion of its initial wet strength over time. However, permanent wet strength in some types of paper products can be an unnecessary and undesirable property. Paper products such as toilet tissues, etc., are generally disposed of after brief periods of use into septic systems and the like. Clogging of these systems can result if the paper product permanently retains its hydrolysis-resistant strength properties. More recently, manufacturers have added temporary wet strength additives to paper products for which wet strength is sufficient for the intended use, but which then decays upon soaking in water. Decay of the wet strength facilitates flow of the paper product through septic systems.

Examples of suitable temporary wet strength resins include modified starch temporary wet strength agents, such as National Starch 78-0080, marketed by the National Starch and Chemical Corporation (New York, N.Y.). This type of wet strength agent can be made by reacting dimethoxyethyl-N-methyl-chloroacetamide with cationic starch polymers. Modified starch temporary wet strength agents are also described in U.S. Pat. No. 4,675,394, Solarek, et al., issued Jun. 23, 1987, and incorporated herein by reference. Preferred temporary wet strength resins include those described in U.S. Pat. No. 4,981,557, Bjorkquist, issued Jan. 1, 1991, and incorporated herein by reference.

With respect to the classes and specific examples of both permanent and temporary wet strength resins listed above, it should be understood that the resins listed are exemplary in nature and are not meant to limit the scope of this invention.

Mixtures of compatible wet strength resins can also be used in the practice of this invention.

The above listings of optional chemical additives is intended to be merely exemplary in nature, and are not meant to limit the scope of the invention.

The following example illustrates the practice of the present invention but is not intended to be limiting thereof.

EXAMPLE

The purpose of this example is to illustrate tissue paper made by a papermaking machine of the type shown in FIG. 1, wherein the wet tissue is treated with an aqueous solution of PEG-400.

A pilot scale Fourdrinier papermaking machine is used in the practice of the present invention. A 3% by weight aqueous slurry of NSK is made up in a conventional re-pulper. The NSK slurry is refined gently and a 2% solution of a permanent wet strength resin (i.e., Kymene 557H marketed by Hercules Incorporated of Wilmington, Del.) is added to the NSK stock pipe at a rate of 1% by weight of the dry fibers. The adsorption of Kymene 557H to NSK is enhanced by an in-line mixer. A 1% solution of Carboxy Methyl Cellulose (CMC) is added after the in-line mixer at a rate of 0.2% by weight of the dry fibers to enhance the dry strength of the fibrous substrate. The NSK slurry is diluted to 0.2% by the fan pump. A 3% by weight aqueous slurry of CTMP is made up in a conventional re-pulper. A non-ionic surfactant (Pegosperse) is added to the re-pulper at a rate of 0.2% by weight of dry fibers. The CTMP slurry is diluted to 0.2% by the fan pump. The treated furnish mixture (NSK/CTMP) is blended in the head box and deposited onto a Foudrinier wire to form a homogenous embryonic web. Dewatering occurs through the Foudrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the Fourdrinier wire, at a fiber consistency of about 22% at the point of transfer, to a photo-polymer belt having 240 Linear Idaho cells per square inch, 34 percent knuckle areas and 14 mils of photo-polymer depth. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

An aqueous solution is sprayed onto the wet tissue paper through spray nozzle 220 which contained an aqueous solution comprising about 50% by weight of a polyhydroxy compound. The polyhydroxy compound used is PEG-400 available commercially from Union Carbide of Danbury, Conn. The wet web has a fiber consistency of about 25%, total web basis weight basis when sprayed by the aqueous solution containing the polyhydroxy compound. Two plies of the web are formed into paper towel products by embossing and laminating them together using PVA adhesive. The paper towel has about 26 #/3M Sq. Ft basis weight, contains about 1% of the PEG-400 and about 0.5% of the permanent wet strength resin. The resulting paper towel is soft, absorbent, and very strong when wetted.

What is claimed is:

1. Tissue paper consisting essentially of:

a) wet-laid cellulosic fibers; and b) from about 0.01% to about 5% of a water soluble polyhydroxy compound, based on the dry fiber weight of said tissue paper, wherein said polyhydroxy compound is selected from the group consisting of, polyglycerols having a weight average molecular weight from about 150 to about 800, polyoxyethylene and polyoxypropylene or polyoxyethylene/polyoxypropylene copolymers having a weight average molecular weight from about 200 to about 1000, and mixtures thereof and mixture of glycerol with polyglycerols having a weight average molecular weight from about 150 to about 800 and mixture of glycerol with polyoxyethylene having weight average molecular weight from about 200 to about 1000;

wherein said tissue paper has a basis weight of from about 10 to about 65 g/m$^2$ and a density of less than about 0.60 g/cc, said polyhydroxy compound having being applied to at least one surface of a wet tissue paper web.

2. The tissue paper of claim 1 wherein said polyhydroxy compound is selected from the group consisting of polyoxyethylene and polyoxypropylene having a weight average molecular weight from about 200 to about 1000.

3. The tissue paper of claim 2 wherein said polyhydroxy compound is a polyoxyethylene having a weight average molecular weight from about 200 to about 1000.

4. The tissue paper of claim 3 wherein said polyoxyethylene has a weight average molecular weight from about 200 to about 600.

5. The tissue paper of claim 1 wherein said polyhydroxy compound is glycerol.

6. The tissue paper of claim 1 wherein said polyhydroxy compound is polyglycerols having a weight average molecular weight of from about 150 to about 800.

7. The tissue paper of claim 1 wherein said polyhydroxy compound is a mixture of glycerol and polyoxyethylene having a weight average molecular weight from about 200 to about 1000.

8. The tissue paper of claim 1 wherein said polyhydroxy compound is a mixture of glycerol and polyglycerols having a weight average molecular weight from about 150 to about 800.

9. The tissue paper of claim 1 wherein said polyhydroxy compound is a mixture of polyglycerols having a weight average molecular weight from about 150 to about 800 and polyoxyethylene having a weight average molecular weight from about 200 to about 1000.

10. The tissue paper of claim 1 further comprising an effective amount of a strength additive.

11. The tissue paper of claim 10 wherein said strength additive is selected from the group consisting of permanent wet strength resins, temporary wet strength resins, dry strength resins, retention aid resins and mixtures thereof.

12. The tissue paper of claim 11 wherein said strength additive is a permanent wet strength resin selected from the group consisting of polyamide-epichlorohydrin resins, polyacrylamide resins, and mixtures thereof.

13. The tissue paper of claim 11 wherein said strength additive is a temporary wet strength resin.

14. The tissue paper of claim 13 wherein said wherein said temporary wet strength resin is a starch-based temporary wet strength resin.

15. The tissue paper of claim 11 wherein said strength additive is a dry strength resin.

16. The tissue paper of claim 15 wherein said dry strength resin is selected from the group consisting of carboxymethyl cellulose resins, starch based resins, and mixtures thereof.

17. The tissue paper of claim 16 wherein said dry strength resin is a carboxymethyl cellulose resin.

18. A process for making soft tissue paper, said process comprising the steps of:

a) wet-laying an aqueous slurry containing cellulosic fibers to form a web;

b) applying to said web at fiber consistency of from about 10% to about 80%, total web weight basis, a sufficient amount of a water soluble polyhydroxy compound to impart a bulk softness to said structure, wherein said polyhydroxy compound is selected from the group consisting of, polyglycerols having a weight average molecular weight from about 150 to about 800, polyoxyethylene and polyoxpropylene or polyoxyethylene/polyoxypropylene copolymers having a weight average molecular weight from about 200 to about 1000, and mixtures thereof and mixture of glycerol with polyglycerols having a weight average molecular weight of from about 150 to about 800 and mixture of glycerol with polyoxyethylene having a weight average molecular weight from about 200 to about 1000; and c) drying and creping said web;

wherein said tissue paper has a dry basis weight of from about 10 to about 65 g/m$^2$ and a density of less than about 0.60 g/cc.

19. The process of claim 18 wherein from about 0.1% to about 2.0%, dry fiber weight basis, of said polyhydroxy compound is retained by said tissue paper.

20. The process of claim 18, further comprising the step of applying to said web, a sufficient amount of a polyamide-epichlorohydrin permanent wet strength resin such that between about 0.2% and about 2.0%, dry fiber weight basis, of said polyamide-epichlorohydrin resin is retained by said web.

21. The process of claim 20, further comprising the step of applying to said web, a sufficient amount of a carboxymethyl cellulose dry strength resin such that between about 0.1% and about 1.0%, dry fiber weight basis, of said carboxymethyl cellulose resin is retained by said web.

22. The process of claim 18, further comprising the step of applying to said web, a sufficient amount of a starch-based temporary wet strength resin such that between about 0.1% and about 1.0%, dry fiber weight basis, of said starch-based resin is retained by said web.

* * * * *